United States Patent [19]

Sheffield

[11] Patent Number: 5,040,300

[45] Date of Patent: Aug. 20, 1991

[54] ARCHERY BOW SIGHT

[76] Inventor: Thomas H. Sheffield, 20 Shirley Ct., Archer, Fla. 32618

[21] Appl. No.: 603,390

[22] Filed: Oct. 26, 1990

[51] Int. Cl.[5] ..... F41G 1/00

[52] U.S. Cl. ..... 33/265; 33/254; 124/87

[58] Field of Search ..... 33/265, 254; 124/87

[56] References Cited

U.S. PATENT DOCUMENTS

| | | | |
|---|---|---|---|
| 2,351,103 | 6/1944 | Brown | 33/265 |
| 2,559,927 | 7/1951 | Beloungy | 33/265 |
| 2,959,860 | 11/1960 | Kowalcyk | 33/265 |
| 2,982,026 | 5/1961 | Peterson | 33/265 |
| 3,058,221 | 10/1962 | McNeel | 33/265 |
| 3,063,151 | 11/1962 | Hanson | 33/265 |
| 3,284,904 | 11/1966 | Rode | 33/265 |
| 3,667,444 | 6/1972 | Depatie et al. | 124/24 |
| 4,553,338 | 11/1985 | Lebeau | 33/265 |
| 4,625,420 | 12/1986 | Figured | 33/265 |
| 4,961,265 | 10/1990 | Roberts | 124/87 |

*Primary Examiner*—William A. Cuchlinski, Jr.
*Assistant Examiner*—Alvin Wirthlin
*Attorney, Agent, or Firm*—Dowell & Dowell

[57] ABSTRACT

A sighting device for archery bows which includes at least one sight element disposed outwardly of a housing which is mounted to the bow and wherein the sight element is positively biased against a range adjustment mechanism that is rotatably mounted through the housing so that the sight element is positively retained in an adjusted position at all times.

5 Claims, 1 Drawing Sheet

ARCHERY BOW SIGHT

BACKGROUND OF THE INVENTION

1. Field of the Invention

This invention is generally directed to sighting devices for use with archery bows and more specifically to a bow sight having a housing which is mounted to the bow and from which extends a sight rod which is positively biased within the housing against a range adjustment mechanism mounted through the housing whereby one or two sight elements which extends outwardly of the housing may be effectively adjusted and positively retained in an adjusted position by the biased arrangement between the adjustment mechanism and the sight rod.

2. History of the Related Art

Heretofore there have been a number of sighting devices which have been designed for use with various types of hunting or target bows. Most conventional bow sights require a manual unlocking or loosening of a bolt or other adjustment mechanism in order to permit the bow sight to be adjusted. In Brown U.S. Pat. No. 2,351,103 , one such sighting device for archery bows is disclosed. The bow sight disclosed in the patent to Brown requires a number of adjustment knobs to be turned in order to align the sight within a sight tube. Further, vertical adjustment of the sight itself requires the loosening of a threaded knob so that the sight may be guided along a slotted channel to a predetermined position and thereafter the threaded knob tightened to engage the sight tube in a fixed position relative to the bow. Unfortunately, with this type of mechanism, should the locking knob utilized to secure the sight housing to the bow become loose the housing will shift thereby taking the sight out of proper alignment. Further, with such sighting devices, whenever an adjustment is necessary the locking mechanism utilized to secure the sight in position must be loosened and thereafter the sight manually shifted to one position or another after which the locking mechanism must be manipulated to secure the sight in place. When tightening the locking mechanism the sight can be accidentally shifted or moved relative to its intended aligned position.

Another type of sighting device is disclosed in U.S. Pat. No. 4,625,420 to a Figured. This sighting device incorporates a sight rod which is disposed through a support rod housed within a sleeve in such a manner that the sight rod binds against the sleeve as the support rod is drawn into engagement with a mounting bracket. Tension to secure the sight rod in place is applied by a nut mounted to a threaded end portion of the support rod. Therefore, as with the reference to Brown, a manual manipulation of the nut is necessary in order to adjust the sight rod with respect to the sight mounting bracket. If the nut is accidentally loosened, the sight rod can be accidentally moved from its adjusted position.

In applicant's copending U.S. patent application Ser. No. 07/617,911 which is a continuation of Ser. No. 07/403,110, now abandoned entitled Compound Archery Bow with Adjustable Sight and Hand Anchor, filed Sept. 5, 1989, an improvement in bow sights is disclosed which incorporates a housing in which an elongated sight rod is pivotally mounted to a support rod which is pivoted by the inner and outer movement of a threaded adjustment member having a hand rotatable crank mounted to one end thereof. Such a sighting device requires that the front and rear sight rods be mounted or keyed to the pivotable shaft so that the front and rear sights are pivoted when the shaft is moved by the inner and outer movement of the threaded adjustment member. In addition, the crank member may only be turned through 180° before the crank engages the housing of the sight mechanism. Therefore, the adjustment of the mechanism is somewhat limited.

Some additional examples of sighting devices for bows are disclosed in U.S. Pat. Nos. 4,553,338 to Le Beau and 3,667,444 to Depatie et al.

Summary of the Invention

A bow sight for archery and hunting bows which includes a housing having a pivoted sight rod mounted therein and wherein the front and rear portions of the sight rod extend outwardly of the housing. The housing is designed to be secured to a bow by any conventional attachment bracket or clamp. The sight also includes vertically oriented sight elements which in the preferred embodiments are peep sights. The sight rod is positively biased within the housing by a spring mechanism which continuously urges the sight rod against the lower portion of a range sight adjustment member. The sight adjustment member is threadingly disposed through the upper portion of the housing and is connected to a manually operable knob which is indexed to indicate the yardage for which the sight mechanism is set.

In an alternate form of the invention, the sight rod may extend from only the rear portion of the housing so that a single sight element is provided.

It is a primary object of the present invention to provide a sight for bows which may be attached to conventional bows and which may be easily operated by one hand to set the distance adjustment and wherein the positioning of the sight elements is continuously assured by the positive biasing of the sight rod relative to the sight adjustment member.

It is yet another object of the present invention to provide a sight for use with archery and hunting bows which is less complex and therefore more economical to manufacture than conventional sights and wherein the adjustment member for the sight elements permits the sight elements to be raised and lowered relative to one another without requiring that the mechanism or the sight rod be unlocked with respect to the sight housing.

DESCRIPTION OF THE PREFERRED EMBODIMENT

Figure 1:
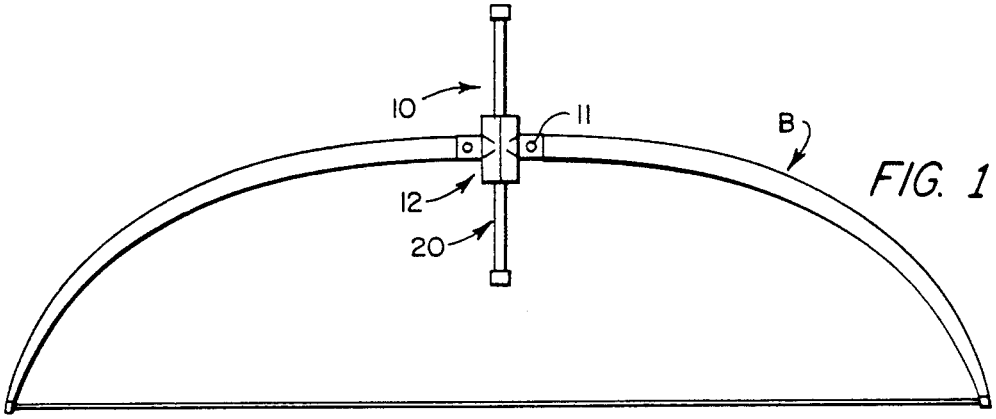
FIG. 1 is a top plan illustrational view showing the sight mechanism of the present invention as utilized with a conventional bow.

With continued reference to the drawings, the sight mechanism 10 of the present invention is shown as being mounted by a bracket 11 to a conventional bow B. In the drawing figures, the sight mechanism is shown as being mounted for use with bow oriented in a horizontal position. The sight mechanism could be utilized with a bow used in a generally vertical position by simply rotating the sight mechanism 90° around its longitudinal axis with respect to its positioning in FIG. 1 and by providing a different mounting bracket to secure the sight mechanism to the bow.

The sight mechanism 10 includes a housing 12 having upper and lower walls 13 and 14 and side walls 15 and 16. The lower wall 14 is secured to the bracket 11 in any conventional manner. The housing further includes front and rear open ends 17 and 18.

Figure 3:
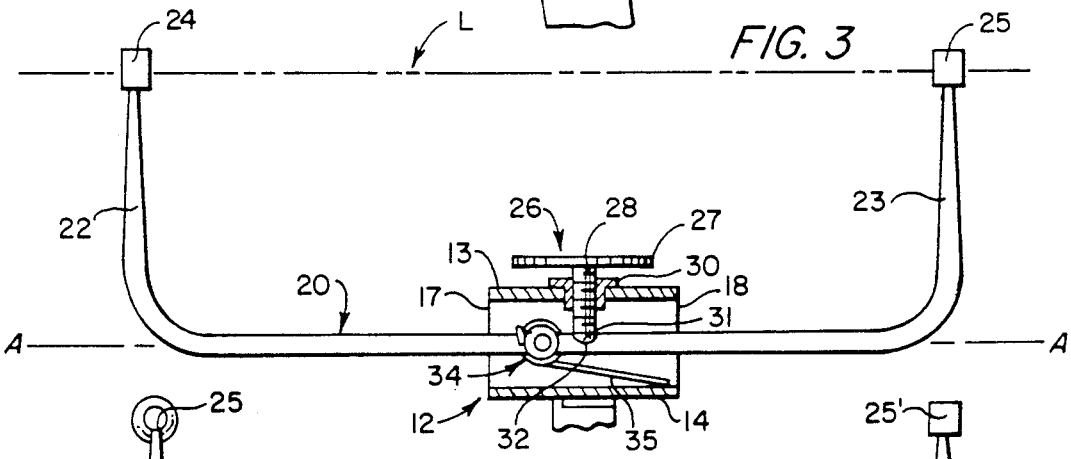
FIG. 3 is a side elevational view having portions broken away to show the interior of the housing of the sight mechanism of the present invention.
Figure 4:
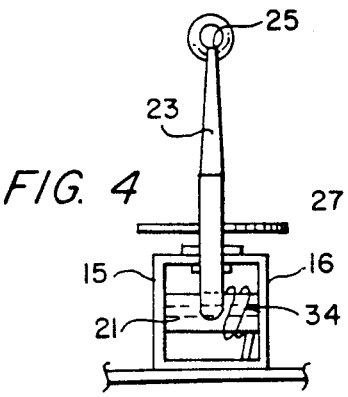
FIG. 4 is a rear elevational view of the sight mechanism of the present invention.

With particular reference to FIGS. 3 and 4 an elongated sight rod 20 extends through the housing and is pivotally mounted thereto by extending through a pivot pin 21 which is mounted through either side 15 and 16 of the housing. The front and rear end portions 22 and 23 of the bow sight rod extend generally perpendicular to the elongated axis A—A of the housing and a pair of peep sight elements 24 and 25 are secured to the outer ends thereof. In the drawing figures, peep sight 25 is the rear sight element while peep sight 24 is the front sight element. Generally, peep sight element 24 will be of a greater diameter than peep sight element 25. It should be noted that the peep sight elements 24 and 25 extend outwardly with respect to the upper wall 13 of the housing so that the housing does not interfere with the sight line L represented in the drawing figures.

In order to adjust the sight rod 20 relative to the housing to compensate for targets at differing ranges, an adjustment member 26 is provided having a rotatable dial or knob portion 27 and a threaded shank portion 28 which extends therefrom. A threaded bushing 30 is provided through the upper portion of the housing 12 and threadingly receives the shank portion 28 of the range adjustment member 26. The lower end 31 of the threaded shank portion 28 forms an abutment surface which bears against a small indentation 32 provided in the sight rod adjacent the pivot pin 21. The point of engagement between the adjustment mechanism and the sight rod is between the pivot pin and the inner end of the housing 18.

In order to continuously and positively bias the sight rod against the lower end 31 of the threaded shank portion 28 of the adjustment member 26, a spring 34 is provided having several turns made about the pivot pin 21 and an outer leg portion 35 which engages the lower wall of the housing. The spring member continuously biases the sight rod 20 against the adjustment member 26 and thereby assures that the front and rear sights 24 and 25 are continuously retained in an adjusted position. Further, whenever an adjustment is made to the adjustment mechanism by rotating the upper dial portion 27 the sight rod is immediately pivoted about the pivot pin 21 and retained in the adjusted position by the biasing of the spring against the adjustment mechanism.

In view of the foregoing, the sight of the present invention is positively retained in an adjusted position by the spring element mounted within the housing. Further, the force generated by the spring against the lower end 31 of the adjustment mechanism 26 will prevent the adjustment mechanism from being accidentally rotated unless sufficient manual force is specifically applied thereto. Also, any change in the adjustment may be easily made by simply rotating the dial 27 of the adjustment member with the fingers of one hand. At no time will the sight rod be released for free movement due to the resilient mounting arrangement of the sight rod within the housing.

Figure 2:
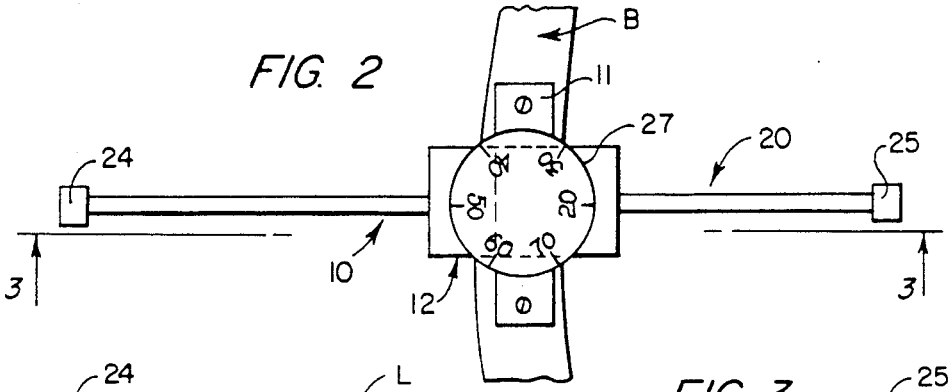
FIG. 2 is an enlarged top plan view of the sight mechanism of the present invention as attached to the bow of FIG. 1.

As shown in FIG. 2, appropriate indicia may be provided on the face of the dial 27 of the adjustment mechanism to indicate the appropriate yardage for which the sight is predetermined to be aligned. This indicia may be an adhesive tape which may be applied by an individual so that the distances may be set by the individual in actual field or training use.

Figure 5:
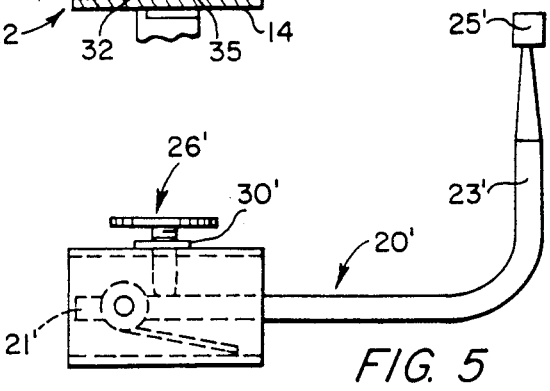
FIG. 5 is a side elevational view of a second embodiment of the sight mechanism of the present invention.

With specific reference to FIG. 5, an alternate embodiment of the present invention is shown wherein the sight rod 20' includes only a rear portion 23' having a rear sight 25' secured thereto. As with the previous embodiment, the adjustment member 26'0 is threaded through a bushing 30' so as to engage the upper portion of the sight rod 20' adjacent the pivot pin 21'. A spring element 34' is also provided to positively bias the sight rod 20' against the lower end 31, of the sight adjustment member 26'.

In the use of the sighting device of the present invention, resetting the sight for additional yardage is accomplished by rotating the dial 27 of the adjustment member 26 so as to urge the end portion 31 thereof downwardly relative to the housing and against the sight rod 20 thereby pivoting the rear sight 25 downwardly with respect to the front sight 24. By rotating the dial 27 in the opposite direction, the threaded end 28 thereof is drawn upwardly through the bushing 30 thereby lowering the front sight element and raising the rear sight element. At all times during both types of adjustment the sight rod 20 will be positively urged against the lower end portion 31 of the adjustment member 26 to thereby ensure that the sight rod is positively retained in an adjusted position.

I claim:

1. A bow sight comprising, a housing having front and rear ends and upper and lower walls and opposing side walls, a pivot means disposed within said housing and mounted to said opposing side walls thereof, sight rod means connected to said pivot means and having first and second end portions extending outwardly of said front and rear ends of said housing, respectively, a sight element carried by each of said first and second end portions of said sight rod means, said sight elements being positioned above said upper wall, a spring means within said housing and connected to said rod means to bias said first end portion of said sight rod means toward said upper wall of said housing, a range adjustment means rotatably mounted through said upper wall of said housing and having abutment means within said housing for engaging said second end portion of said sight rod means adjacent said pivot means whereby upon rotation of said adjustment means said rod means is moved relative to said upper wall of said housing while being continuously biased against said spring means.

2. The bow sight of claim 1 in which said sight elements are generally circular peep sights.

3. The bow sight of claim 2 in which said peep sight of said first end portion of said sight rod means has a greater diameter than said peep sight of said second end portion of said sight rod means.

4. The bow sight of claim 1 in which said range adjustment means includes a dial positioned exteriorly of said upper wall of said housing.

5. A bow sight comprising, a housing having front and rear ends and upper and lower walls and opposing side walls, a pivot means disposed within said housing and mounted to said opposing side walls thereof, sight rod means connected to said pivot means and having at least one end portion extending outwardly of said rear end of said housing, said at least one end portion of said sight rod means including a sight element, said sight element being positioned above said upper wall, a spring means within said housing and connected to said rod means to bias said at least one end portion of said sight rod means toward said upper wall of said housing, a range adjustment means rotatably mounted through said upper wall of said housing and having abutment means extending within said housing for engaging said at least one end portion of said sight rod means adjacent said pivot means whereby upon rotation of said range adjustment means said rod means is moved relative to said upper wall of said housing while being continuously biased against said spring means.

* * * * *